US009845571B2

(12) United States Patent
Kirth et al.

(10) Patent No.: US 9,845,571 B2
(45) **Date of Patent: *Dec. 19, 2017**

(54) CORE-SHEATH ROPE

(71) Applicant: TEUFELBERGER GESELLSCHAFT M.B.H., Wels (AT)

(72) Inventors: Rudolf Kirth, Vöcklabruck (AT); Klaus Hemmers, Grieskirchen (AT); Uwe Künzel, Traun (AT); Rene Mäser, Amstetten (AT); Susanna Schiemer, Linz (AT)

(73) Assignee: TEUFELBERGER GESELLSCHAFT M.B.H., Wels (AT)

( * ) Notice: Subject to any disclaimer, the term of this patent is extended or adjusted under 35 U.S.C. 154(b) by 417 days.

This patent is subject to a terminal disclaimer.

(21) Appl. No.: 14/387,221

(22) PCT Filed: Mar. 21, 2013

(86) PCT No.: PCT/EP2013/055922

§ 371 (c)(1),
(2) Date: Sep. 22, 2014

(87) PCT Pub. No.: WO2013/143965

PCT Pub. Date: Oct. 3, 2013

(65) Prior Publication Data

US 2015/0040746 A1 Feb. 12, 2015

(30) Foreign Application Priority Data

Mar. 30, 2012 (AT) ..... A 396/2012

(51) Int. Cl.
*D07B 1/04* (2006.01)
*D04C 3/40* (2006.01)
(Continued)

(52) U.S. Cl.
CPC ..... *D07B 1/04* (2013.01); *D04C 1/06* (2013.01); *D04C 3/12* (2013.01); *D04C 3/40* (2013.01);
(Continued)

(58) Field of Classification Search
CPC ... D07B 1/04; D04C 1/06; D04C 3/12; D04C 3/40
See application file for complete search history.

(56) References Cited

U.S. PATENT DOCUMENTS 2,600,395 A 6/1952 Domoj et al.
4,192,127 A 3/1980 O'Neil et al.
(Continued)

FOREIGN PATENT DOCUMENTS

AT 00358433 1/1980
DE 00131208 6/1901
(Continued)

OTHER PUBLICATIONS

International Preliminary Report on Patentability for PCT Application Serial No. PCT/EP2013/055922 dated Oct. 1, 2014.

*Primary Examiner* — Shaun R Hurley
(74) *Attorney, Agent, or Firm* — Workman Nydegger

(57) ABSTRACT

A core-sheath rope can include an outer sheath provided in the form of a hollow braid and an inner sheath provided in the form of a hollow braid, wherein thread changes between threads of the inner sheath and threads of the outer sheath and/or enlacements between threads of the inner sheath and threads of the outer sheath are provided in certain places. The rope can be characterized in that bridge threads extending in the longitudinal direction of the rope are provided in the places of the thread changes and/or enlacements, with the threads of the outer sheath and the inner sheath, respectively, which change from the inside to the outside and from
(Continued)

Figure 1:
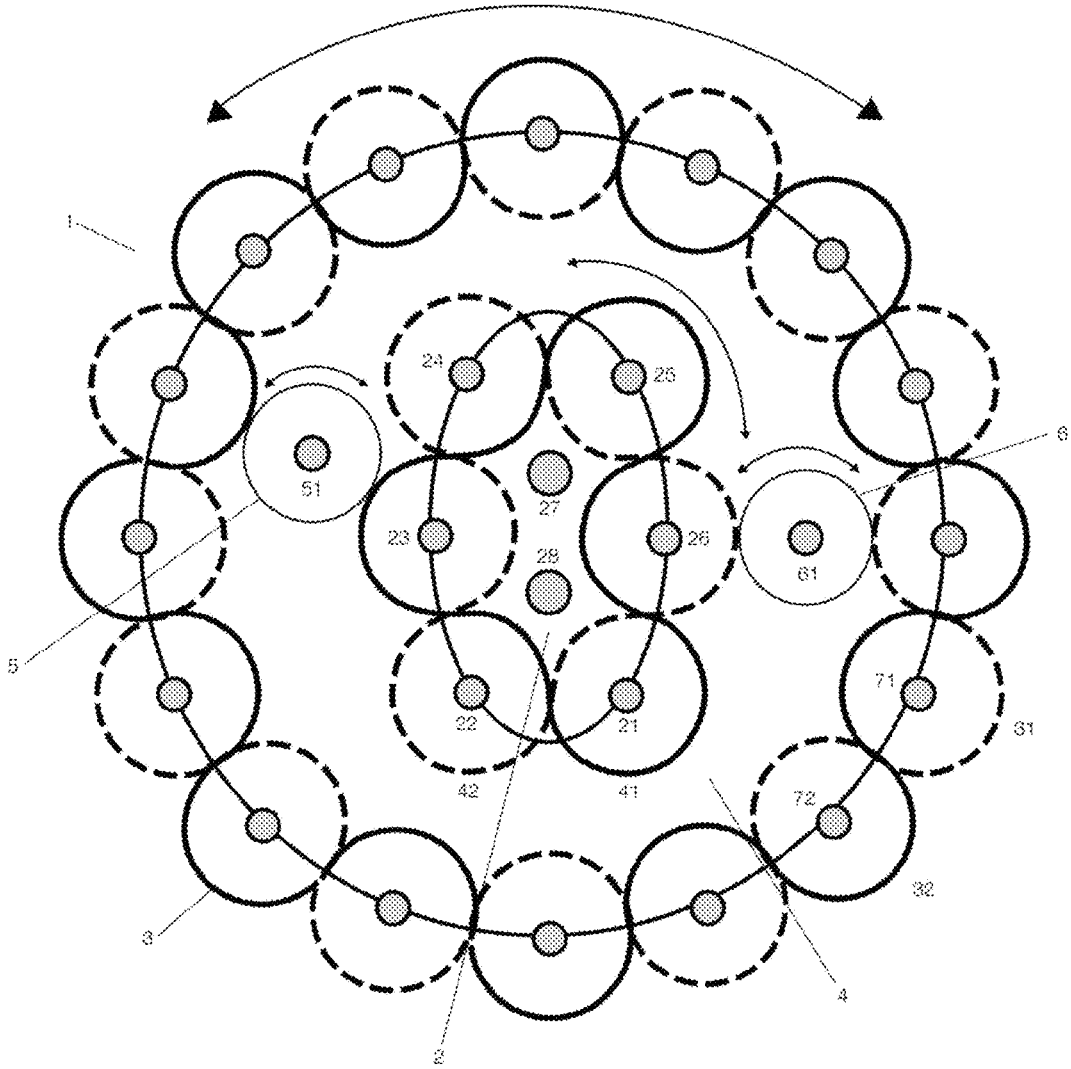

the outside to the inside, respectively, being guided around those bridge threads.

19 Claims, 7 Drawing Sheets

(51) Int. Cl.
*D04C 3/12* (2006.01)
*D04C 1/06* (2006.01)

(52) U.S. Cl.
CPC ..... *D07B 2201/209* (2013.01); *D07B 2201/2088* (2013.01); *D07B 2401/205* (2013.01)

(56) References Cited

U.S. PATENT DOCUMENTS 4,312,260 A 1/1982 Morieras
5,188,872 A 2/1993 Quigley
5,358,262 A * 10/1994 Roberts ..... F16J 15/0812 277/652
5,396,829 A * 3/1995 Akiyama ..... B29C 70/16 87/29
7,360,477 B2 * 4/2008 Hess ..... D07B 1/025 57/210
7,784,258 B2 * 8/2010 Hess ..... D07B 1/02 57/210
2005/0011344 A1 * 1/2005 Hess ..... D07B 1/025 87/5
2007/0137163 A1 * 6/2007 Hess ..... D07B 1/02 57/210
2010/0162882 A1 * 7/2010 Shakespeare ..... A62B 1/16 87/6
2015/0059563 A1 * 3/2015 Kirth ..... D04C 1/12 87/6

FOREIGN PATENT DOCUMENTS

DE 223466 6/1910
DE 2541763 3/1977
DE 7823387 11/1978
DE 3129857 2/1983
DE 4035814 5/1992
DE 4038161 6/1992
DE 19819522 11/1999
DE 102007063052 7/2009
DE 102009017312 A1 † 10/2010
EP 0150702 8/1985
EP 1248872 10/2002
EP 1248872 B1 † 10/2002
EP 1700948 9/2006
EP 2063018 5/2009
EP 2239359 10/2010
FR 00334887 11/1903
GB 325421 2/1930
GB 724604 2/1955
GB 891741 3/1962
WO WO2003027383 4/2003
WO WO2005085518 9/2005
WO WO2006055995 6/2006
WO WO2009047342 4/2009

* cited by examiner
† cited by third party

CORE-SHEATH ROPE

The present invention relates to a core-sheath rope, comprising an outer sheath provided in the form of a hollow braid and an inner sheath provided in the form of a hollow braid.

Core-sheath ropes are known and described, for instance, in AT 358.433B, WO 2003/27383 A, WO 2005/085518 A, DE 40 35 814 A1, U.S. Pat. No. 4,312,260 A and DE 40 38 161 A.

In existing core-sheath ropes, the inadequate connection between core and sheath turns out to be problematic. In particular, a relative displacement of core and sheath may occur when the rope is in use. Said displacement leads to undesirable slubs, poor force transmission from the sheath into the core and excessive stress in the sheath, as a result of which the sheath may even be torn. There are different approaches to the problem of preventing this core-sheath displacement:

One possibility is to use an adhesive or an adhesive tape (see, e.g., DE 40 38 161 A or GB 891,741). The gluing, however, is not lastingly durable, and, in addition, it prevents any relative motion between the core and the sheath, thus leading to a stiffening of the ropes and hence to poor knotability.

Furthermore, it is known to bring the core and the sheath into a more intimate contact by connecting threads from the core with threads from the sheath or by additional transverse threads (see, e.g., WO 2003/27383A, WO 2005/088518A).

In Documents EP 2 239 359 A1, DE 10 2007 063 052 A1, DE 131208 C and DE 223466 C, braiding machines are described wherein, as a result of appropriately arranging the braiding bobbins, thread changes are provided to the effect that threads will change from the outer area of the rope (e.g., an outer sheath) into the inner area (e.g., an inner sheath) and vice versa. Likewise, an interlacing between outer and inner threads may be provided according to those documents.

EP 2 063 018 describes a strand element with a central core made of a silicone material which is encompassed by a textile sheath. From WO 2006/055995, it is known to provide the individual elements of a rope with a reinforcement. Further prior art is disclosed in FR 334.887, U.S. Pat. No. 2,600,395 A, DE 25 41 763 A and U.S. Pat. No. 4,192,127 A.

There is still a need for core-sheath ropes with satisfying performance characteristics, in particular with regard to the stability of the connection of the core and the sheath throughout the entire service life of the rope.

Therefore, the present invention provides a core-sheath rope, comprising an outer sheath provided in the form of a hollow braid and an inner sheath provided in the form of a hollow braid, wherein thread changes between threads of the inner sheath and threads of the outer sheath and/or enlacements between threads of the inner sheath and threads of the outer sheath are provided in certain places, said rope being characterized in that, in said places, bridge threads extending in the longitudinal direction of the rope are provided, with the threads of the outer sheath and the inner sheath, respectively, which change from the inside to the outside and from the outside to the inside, respectively, being guided around those bridge threads.

SHORT DESCRIPTION OF THE FIGURES

FIG. 1 schematically shows the structure of a preferred embodiment of a core-sheath rope according to the invention as well as the manufacture thereof.

FIGS. 2 to 7 schematically show alternative embodiments of thread changes and enlacements, respectively.

DETAILED DESCRIPTION OF THE INVENTION

For the purposes of the present invention, the term "threads" is understood to mean the filamentary components of a rope such as, e.g., twines or braided elements. A thread may thereby be composed of several adjacent elements such as, e.g., several adjacent twines, the adjacent elements taking the same course across the entire rope.

In the following, the term "stationary threads" denotes threads which—unlike the threads of the inner and outer sheaths—extend entirely in the longitudinal direction of the rope.

For the purposes of the present invention, the term "core" also covers the mere existence of an inner hollow braid. This means that, in an embodiment of a rope merely consisting of an outer hollow braid (outer sheath) and an inner hollow braid (inner sheath) without any additional stationary threads within the core, the inner sheath forms the core of the rope.

Starting from the thread changes between threads of the outer sheath and the inner sheath as well as on enlacements between threads of the outer sheath and the inner sheath as described in the above-cited documents, the present invention provides additional stationary threads (bridge threads) extending in the longitudinal direction in the places of a thread change or an enlacement, respectively.

Thereby, the following possibilities are conceivable:

- A change of the thread from the outer sheath into the inner sheath and vice versa, with the thread guided from the inside to the outside and the thread guided from the outside to the inside are being guided around the bridge thread, respectively.
- A thread of the inner sheath and a thread of the outer sheath are guided around each other, but, subsequently, they continue to be guided again in the original position, i.e., the thread of the inner sheath is continued again in the inner sheath and, analogously thereto, the thread of the outer sheath is continued again in the outer sheath. The bridge thread is thereby located between the threads of the inner sheath and the outer sheath and is enlaced by at least one of the threads. Although, in said variant, the thread of the inner sheath and the thread of the outer sheath are not interlaced directly with each other, but via the bridge thread, said embodiment is referred to as an "enlacement" for the purposes of the present invention.
- An enlacement and a thread change, i.e., a thread of the inner sheath and a thread of the outer sheath are guided around each other as described above, but, in addition, they change position, i.e., the thread of the inner sheath continues to be guided in the outer sheath and vice versa. The bridge thread is thereby located between the threads of the inner sheath and the outer sheath and is enlaced by both threads.

Preferably, the bridge threads are enlaced by the threads of the inner sheath and the threads of the outer sheath.

However, in all cases, the bridge threads provided according to the invention are embraced both by the threads of the outer sheath and the threads of the inner sheath and thus form a bridge between the outer sheath and the inner sheath. At the same time, the (load-bearing) bridge thread remains in the pulling direction so that it will contribute to the breaking load of the rope, which is determined primarily by the threads in the pulling direction.

Of course, the threads of the inner sheath and the threads of the outer sheath can be guided around the bridge thread also several times and, subsequently, they either can continue to be guided in their original position or they can change position from the outside to the inside and vice versa.

The rope according to the invention preferably comprises, in a manner known per se, within the core one or several stationary threads extending in the longitudinal direction of the rope.

Core-sheath ropes as known from the prior art comprise a textile core with one or several stationary threads extending in the longitudinal direction of the rope, the core being surrounded by an inner sheath in the form of a hollow braid, as well as an outer sheath provided in the form of a hollow braid.

In a further preferred embodiment of the present invention, at least part of the core's stationary threads extending in the longitudinal direction of the rope are braided individually into the hollow braid of the inner sheath. As explained above, the term "thread" thereby covers also a plurality of adjacent rope elements such as, e.g., a bundle of several adjacent stationary threads originating from a single aperture.

In contrast to suggestions according to which all stationary threads of the core are enlaced by the sheath or, otherwise, individual stationary threads exhibit a reinforcement, but are not connected to each other, according to the invention stationary threads of the core are thus braided into the hollow braid of the inner sheath. Furthermore, the stationary threads of the core are connected to the outer sheath via the thread changes and enlacements, respectively, of the threads of the outer and the inner sheaths as well as via the bridge threads provided according to the invention. This leads to an even better connection and integration of the core into the inner sheath and the outer sheath.

Preferably, some of the stationary threads of the core are not braided individually into the hollow braid of the inner sheath.

In particular, the stationary threads which are not braided individually into the hollow braid of the inner sheath are preferably arranged in the centre of the core.

In said embodiment, stationary threads of the core are thus provided in the centre of the core without any interconnection and without being braided into the inner sheath, while further threads are braided into the hollow braid of the inner sheath.

Preferably, the bridge threads consist of the same material as the threads of the core.

In a further preferred embodiment, the core-sheath rope according to the invention comprises threads which differ from each other by way of one or more properties.

Particularly properties such as colour, titre, fibre type (e.g., monofilament, staple fibre, multifilament), fibre material (e.g., polyamide, aramide, HMW-PE) or structure (e.g., twines of different folding numbers and/or rotations) are considered here.

For example, the threads which are guided initially in the inner sheath and the threads which are guided initially in the outer sheath may have different colours. In this way, the changes can be made identifiable from the outside in terms of colour. Length markings on the rope are also possible through colour changes. Threads having different properties, in particular colours, may also be provided within the thread material of the inner sheath and/or the outer sheath.

In a further preferred embodiment, the core-sheath rope according to the invention comprises threads of different fineness. For example, the threads which are guided initially in the inner sheath and the threads which are guided initially in the outer sheath can be of different fineness (titres). Large differences in fineness will lead in particular to intentional irregularities in the rope and varying roughness at a thread change.

Preferably, the core-sheath rope according to the invention comprises further stationary threads extending in the longitudinal direction of the rope and braided individually into the hollow braid of the outer sheath. Thus, further tensile-load-bearing elements are provided in the outer region of the rope, which are intimately connected to the threads of the sheath, in this case the outer sheath, also by being enlaced by these threads.

The bridge threads and/or the stationary threads of the outer sheath may consist of the same material as the stationary threads of the core.

Apart from that, all materials familiar to a person skilled in the art may be chosen for the rope according to the invention.

FIG. 1 schematically shows the structure of a preferred embodiment of the rope 1 according to the invention as well as the manufacture thereof on the basis of a possible arrangement in a circular braiding machine. For equipment-related details of such a braiding machine, reference is made to the above-cited relevant documents of the prior art.

The rope 1 comprises a core 2 with several core threads (stationary threads) 21-28. An inner sheath 4 is located around those stationary threads. Furthermore, an outer sheath 3 is provided. However, the core might also be formed exclusively of the inner sheath 4, without any stationary threads 21-28.

The inner sheath 4 and the outer sheath 3 are formed by braids in a manner known per se, wherein the threads of the inner sheath and the threads of the outer sheath, respectively, are interlaced with each other by means of braiding bobbins (not illustrated). In a known manner, the braiding bobbins are arranged on driving wheels (not illustrated). For the production of the inner sheath, 12 braiding bobbins can be provided, for example, of which 6 bobbins are guided in the Z-direction and, respectively, 6 bobbins are guided in the S-direction. The thread paths resulting therefrom are indicated by solid and dashed lines, respectively. The same applies analogously to the outer sheath. Only exemplarily, two threads of the inner sheath are indicated by reference numerals 41 and 42, and two threads of the outer sheath by reference numerals 31 and 32.

Positions for thread changes and enlacements, respectively, are illustrated by reference numerals 5 and 6, wherein, as explained above, threads of the outer sheath change into the inner sheath and vice versa and/or threads of the outer sheath and threads of the inner sheath are interlaced with each other. This is achieved, as known per se, by appropriately positioning two braiding bobbins (not illustrated) on a driving wheel (not illustrated).

According to the invention, bridge threads 51 and 61 are now arranged in the thread-change positions 5 and 6 in such a manner that they end up lying between the threads changing from the outside to the inside (and vice versa) or, respectively, between the threads embracing each other. With regard to the equipment, this is implemented by providing an aperture in the driving wheel in charge of the thread change or the enlacement, respectively.

After the rope has been finished, those bridge threads are thus intimately connected to the threads of the inner and outer sheaths and in this way provide for an even better connection between those two elements, while simultaneously increasing the breaking load of the rope.

The exact method of the thread change and the enlacement, respectively, now depends, on the one hand, on by how many degrees the braiding bobbins are guided around each other on the driving wheels of thread-change positions 5 and 6 and also, on the other hand, on as to whether the threads of the outer and inner sheaths, which threads change with each other or, respectively, interlace with each other, are guided in the opposite or in the same direction.

As to whether the threads of the outer and inner sheaths changing with each other or, respectively, interlacing with each other, are guided in the opposite or in the same direction depends on the direction of rotation of the driving wheels of the inner sheath and the outer sheath, respectively: If the driving wheels are guided in opposite directions, the threads of the inner and outer sheaths changing with each other or, respectively, interlacing with each other, will be under a guidance in the same direction and vice versa.

A few possible variants are explained on the basis of FIGS. 2 to 7:

Therein, the course of a thread (A) which (at first) is located in the outer sheath is schematically illustrated with a thick dotted line and the course of a thread (I) which (at first) is located in the inner sheath is illustrated with a thick dashed line, in each case, in the area of the thread-change position 6. The moving direction of the threads (A) and (I) on the braiding machine, namely in a clockwise direction or in an anti-clockwise direction, is indicated, in each case, with arrows in the region of the inner sheath and the outer sheath, respectively.

Figure 2:
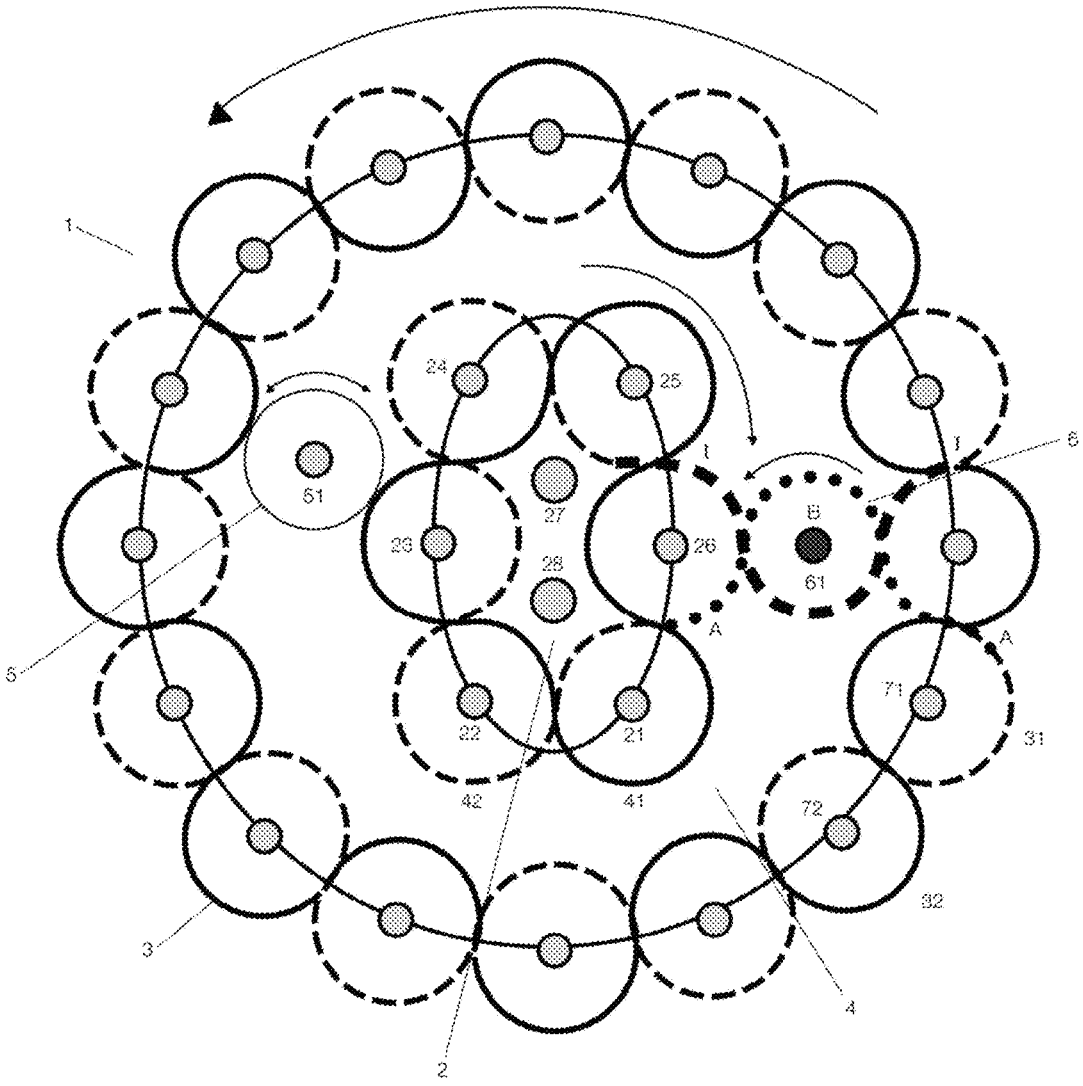

FIG. 2 shows a "simple" thread change of a thread (A) coming from the outer sheath and a thread (I) coming from the inner sheath in a variant wherein A and I are guided in opposite directions. Thread A changes to the inside, and thread I changes to the outside, the threads being guided around the bridge thread B. This is achieved constructionally in that the braiding bobbins which carry the threads A and I, respectively, are guided around 180° on the driving wheel of the thread-change position.

Figure 3:
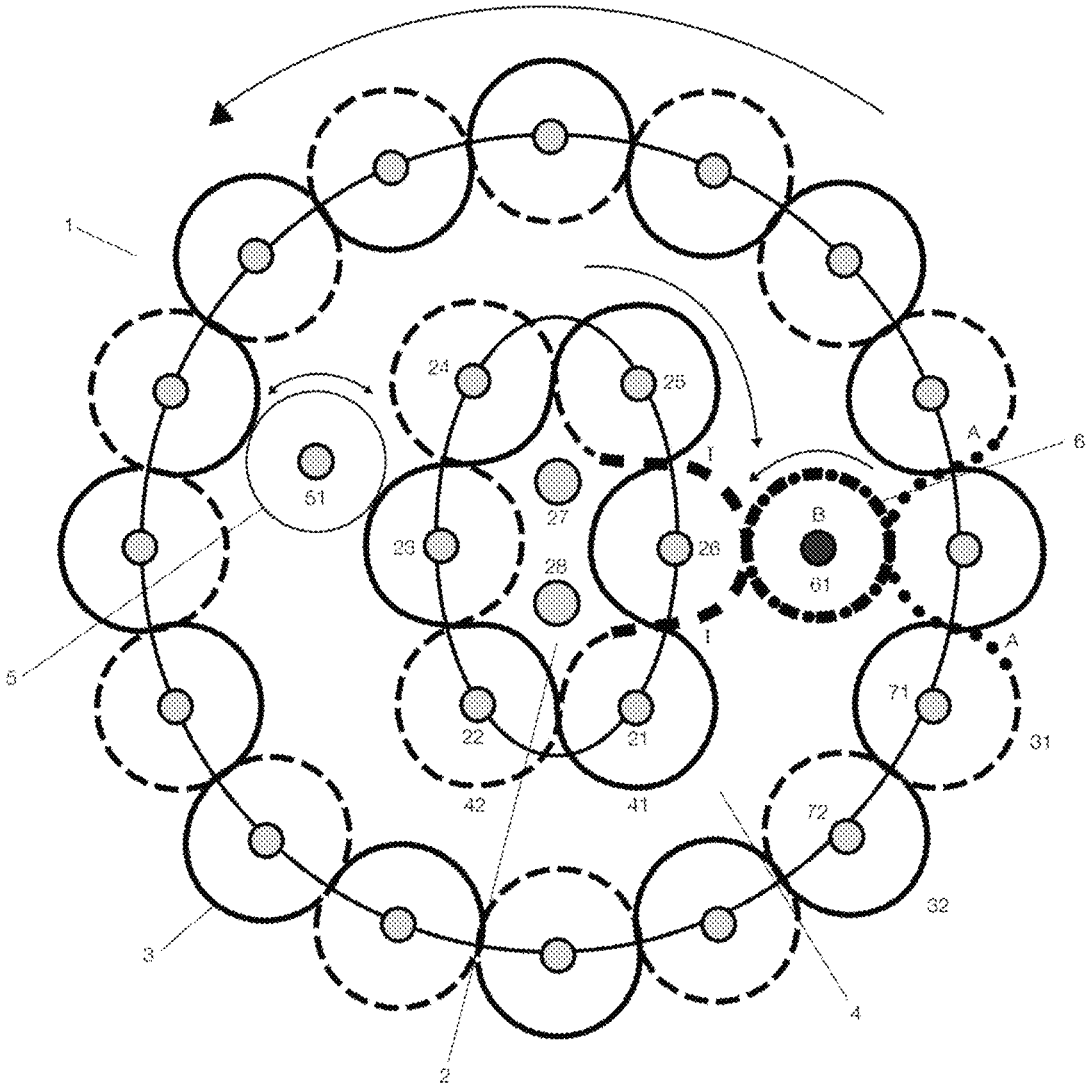

FIG. 3 shows an enlacement, i.e., the outer thread A and the inner thread I are guided around each other once, but then continue to be guided again into the original position (i.e., A into the outer sheath and I into the inner sheath). This is achieved constructionally in that the braiding bobbins which carry the threads A and I, respectively, are guided around 360° on the driving wheel of the thread-change position. The bridge thread B is located in the middle of threads A and I and is thus enlaced by them.

Figure 4:
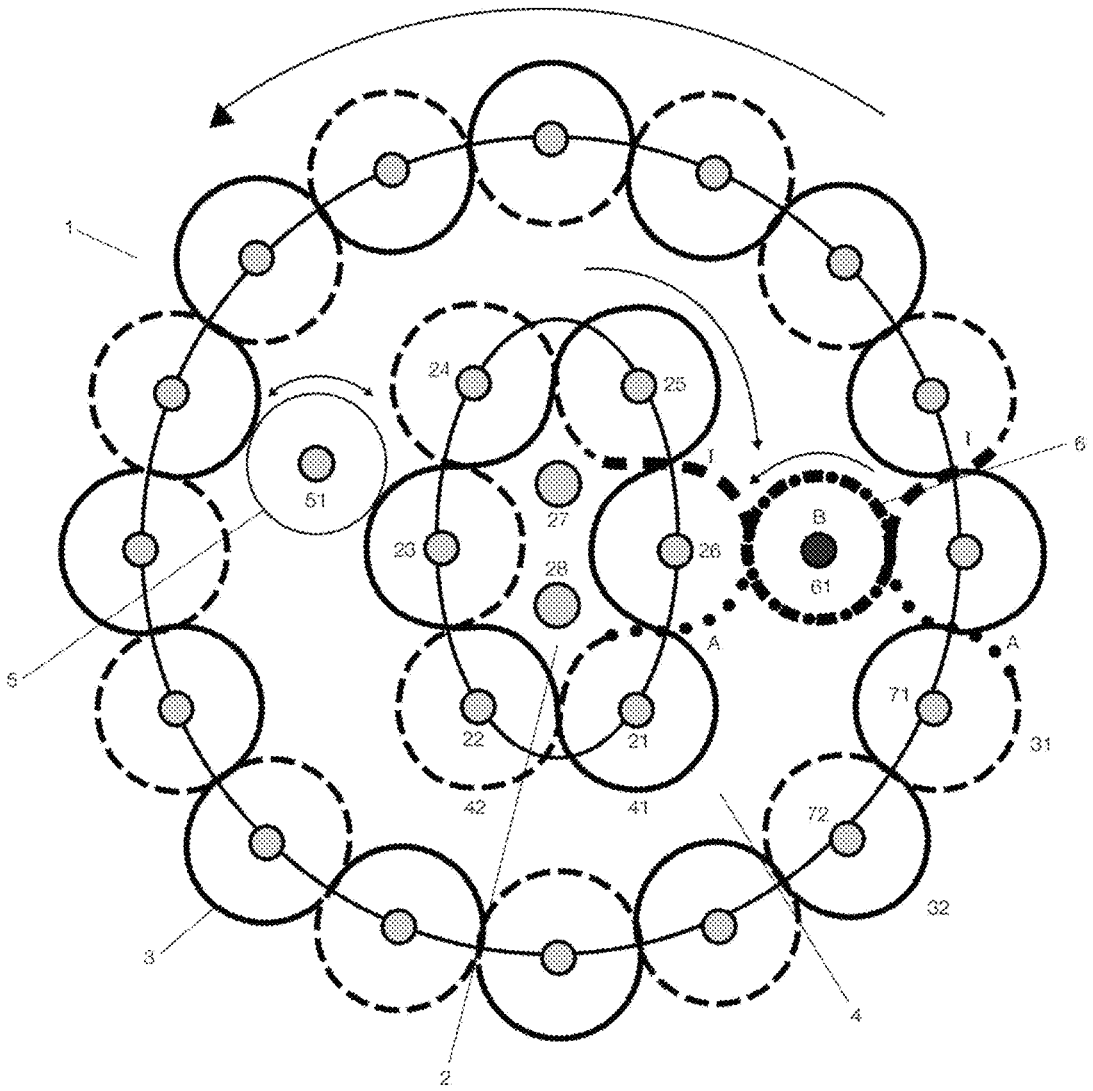

FIG. 4 shows an enlacement with a thread change, i.e., a thread A coming from the outer sheath and a thread I coming from the inner sheath are guided around each other once and subsequently change position, i.e., thread A changes into the inner sheath and thread I changes into the outer sheath. This is achieved constructionally in that the braiding bobbins which carry the threads A and I, respectively, are guided around 540° (360°+additional) 180°) on the driving wheel of the thread-change position. The bridge thread B is again located in the middle of threads A and I and is thus enlaced by them.

Figure 5:
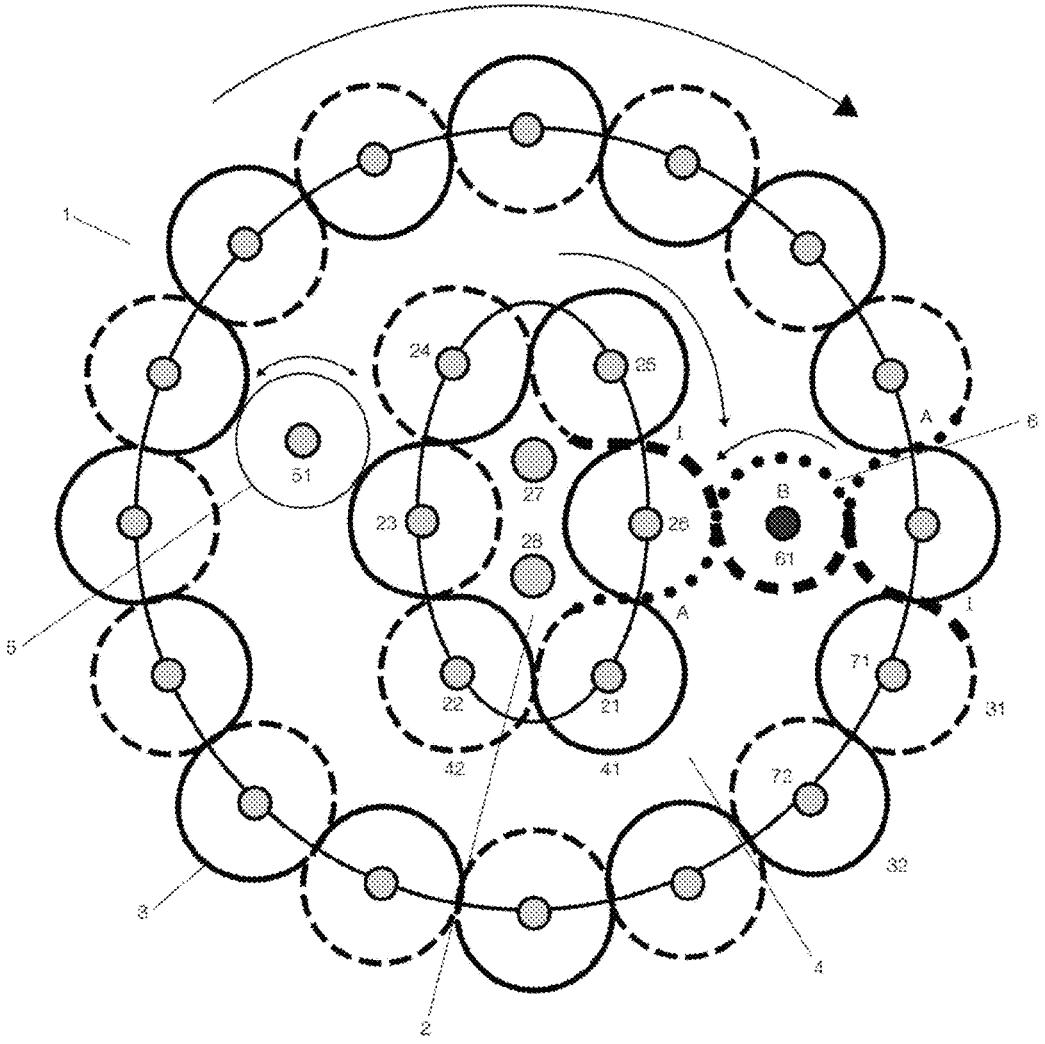
Figure 6:
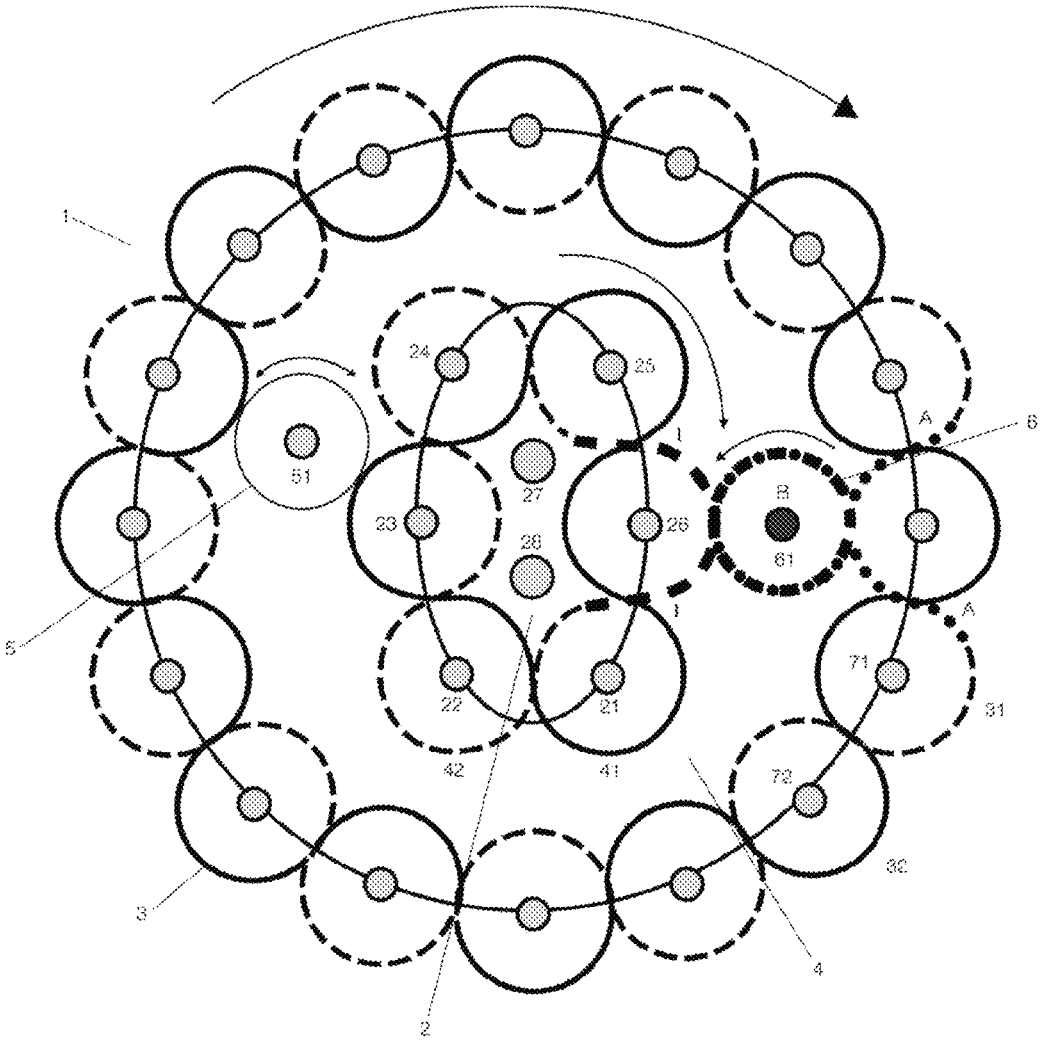
Figure 7:
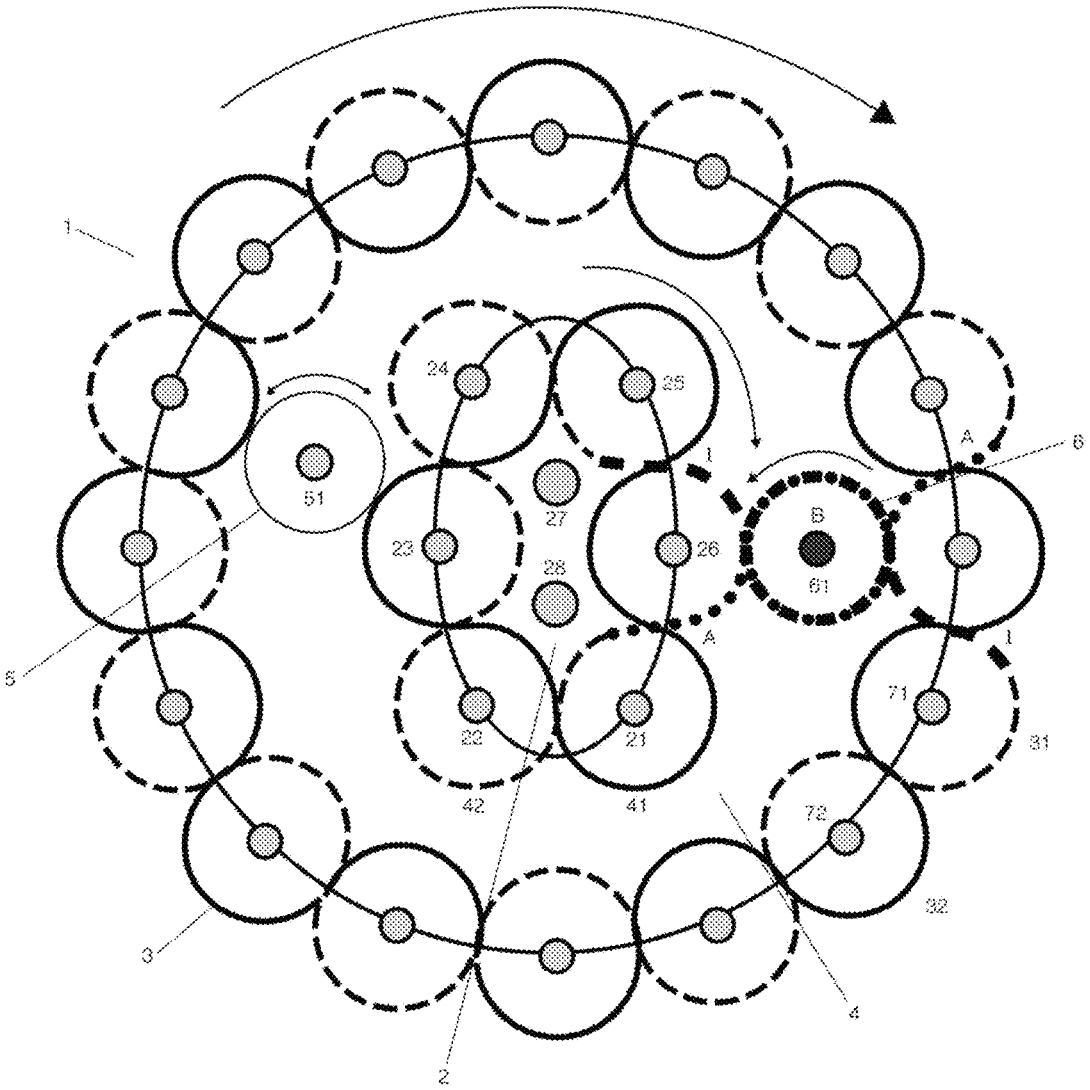

FIGS. 5 to 7 show embodiments analogous to FIGS. 2 to 4, wherein, however, the threads A coming from the outer sheath and the threads I coming from the inner sheath are guided in the same direction. The thread courses which are different from FIGS. 2 to 4 can be seen, and they are also visible in the finished rope.

According to the invention, it is preferred if the threads of the outer sheath and the inner sheath, which change with each other or, respectively, interlace with each other, are guided in opposite directions.

According to the preferred embodiment of the present invention, the core comprises stationary threads and some of the core's stationary threads are braided individually into the hollow braid of the inner sheath. This is illustrated in FIG. 1 for the threads 21 to 26, which, in each case, are braided individually into the threads (for example: 41, 42) of the inner sheath. The threads 21 to 26 may consist of one or also of several adjacent elements such as, e.g., twines, which are supplied from apertures in the driving wheels.

Moreover, in the embodiment illustrated in FIG. 1, the core comprises two stationary threads 27 and 28, which are located in the centre of the core. In fact, when the rope is finished, these are, of course, in intimate contact with the threads of the inner sheath and also the other stationary threads of the core, however, they are neither connected to each other nor braided into the inner sheath.

Similarly as with the stationary threads 21 to 26 of the core, stationary threads in the longitudinal direction may also be provided in the region of the outer sheath, with the threads of the outer sheath being braided around those stationary threads. This is illustrated in FIG. 1 only by way of example via reference numerals 71 and 72.

The invention claimed is:

1. A core-sheath rope, comprising:

an outer sheath provided in the form of a hollow braid; and an inner sheath provided in the form of a hollow braid, wherein thread changes between threads of the inner sheath and threads of the outer sheath and/or enlacements between threads of the inner sheath and threads of the outer sheath are provided in certain places, and wherein in said places of the thread changes or enlacements, bridge threads extending in a longitudinal direction of the rope are provided, with the threads of the outer sheath and the inner sheath, respectively, which change from the inside to the outside and from the outside to the inside, respectively, being guided around the bridge threads.

2. A core-sheath rope according to claim 1, wherein the bridge threads are enlaced by the threads of the inner sheath and the threads of the outer sheath.

3. A core-sheath rope according to claim 1, wherein the rope comprises within the core one or several stationary threads extending in the longitudinal direction of the rope.

4. A core-sheath rope according to claim 3, wherein at least some of the core's stationary threads are braided individually into the hollow braid of the inner sheath.

5. A core-sheath rope according to claim 4, wherein some of the stationary threads of the core are not braided individually into the hollow braid of the inner sheath.

6. A core-sheath rope according to claim 5, wherein the stationary threads which are not braided individually into the hollow braid of the inner sheath are arranged in the centre of the core.

7. A core-sheath rope according to claim 1, wherein the bridge threads consist of the same material as the threads of the core.

8. A core-sheath rope according to claim 1, wherein the rope comprises threads which differ from each other by way of one or more properties.

9. A core-sheath rope according to claim 1, wherein the rope further comprises stationary threads braided individually into the hollow braid of the outer sheath.

10. A core-sheath rope according to claim 1, the threads of the inner sheath and the outer sheath changing with each other or, respectively, interlacing with each other, are guided in opposite directions.

11. A core-sheath rope, comprising:

a first plurality of braided threads, the first plurality of braided threads defining an outer sheath bounding an interior region;

a second plurality of braided threads, the second plurality of braided threads defining an inner sheath, the inner sheath being disposed within the interior region of the outer sheath; and one or more bridge threads extending in a longitudinal direction of the rope and disposed within the interior region and adjacent to an exterior surface of the inner sheath, wherein one or more threads of the first plurality of braided threads defining the outer sheath and one or more threads of the second plurality of braided threads defining the inner sheath are enlaced via the one or more bridge threads at one or more locations along the rope.

12. The core-sheath rope of claim 11, further comprising one or more stationary threads extending in the longitudinal direction of the rope, the one or more stationary threads being disposed at a centre of the inner sheath.

13. The core-sheath rope of claim 12, wherein the one or more stationary threads are not braided into the inner sheath.

14. The core-sheath rope of claim 11, wherein the one or more threads of the first plurality of braided threads and the one or more threads of the second plurality of braided threads enlace the one or more bridge threads in opposite directions.

15. The core-sheath rope of claim 11, wherein subsequent to enlacing about the one or more bridge threads, the one or more bridge threads guide a thread change between a thread of the first plurality of braided threads to the inner sheath and an exchanged thread of the second plurality of braided threads to the outer sheath.

16. A core-sheath rope, comprising:

a first plurality of braided threads, the first plurality of braided threads defining an outer sheath bounding an interior region;

a second plurality of braided threads, the second plurality of braided threads defining an inner sheath, the inner sheath being disposed within the interior region of the outer sheath; and one or more bridge threads disposed within the interior region and adjacent to an exterior surface of the inner sheath, wherein the one or more bridge threads guide a thread change comprising movement of a thread of the first plurality of braided threads to the inner sheath and complementary movement of an exchanged thread of the second plurality of braided threads to the outer sheath at one or more locations along the rope.

17. The core-sheath rope of claim 16, wherein the one or more bridge threads extend in a longitudinal direction of the rope.

18. The core-sheath rope of claim 17, further comprising one or more stationary threads extending in the longitudinal direction of the rope, the one or more stationary threads being disposed at a centre of the inner sheath.

19. The core-sheath rope of claim 18, wherein the one or more stationary threads are not braided into the inner sheath.

* * * * *